US005649845A

United States Patent [19]

Fechtner

[11] Patent Number: 5,649,845

[45] Date of Patent: Jul. 22, 1997

[54] FLAPPING PADDLE AND VERTICAL STABILIZER FOR SWIMMER

[76] Inventor: Ryszard Fechtner, 8748 Jade Ct., Boynton Beach, Fla. 33437

[21] Appl. No.: 740,198

[22] Filed: Oct. 24, 1996

[51] Int. Cl.[6] ..... A63B 31/10

[52] U.S. Cl. ..... 441/56; 441/60

[58] Field of Search ..... 441/55–59, 60, 441/61; 416/70 R; 440/15, 21, 101

[56] References Cited

U.S. PATENT DOCUMENTS

| | | | |
|---|---|---|---|
| 2,009,551 | 7/1935 | Huebner | 441/56 |
| 2,948,255 | 8/1960 | Sbrana . | |
| 3,510,894 | 5/1970 | Eriksen . | |
| 3,987,509 | 10/1976 | Patterman . | |
| 4,857,024 | 8/1989 | Evans . | |
| 5,114,371 | 5/1992 | Alonzo . | |
| 5,348,503 | 9/1994 | Fechtner . | |
| 5,362,268 | 11/1994 | Nordbeck . | |

FOREIGN PATENT DOCUMENTS

| | | |
|---|---|---|
| 757954 | 5/1967 | Canada . |

*Primary Examiner*—Stephen Avila

[57] ABSTRACT

A swimming paddle assembly has a long shaft with a rigid blade at each end. A pair of resilient flaps are attached to the leading edge of each blade, one on each side, so that as the swimmer pulls first on one side of the shaft and then the other side, one blade is pushed forward and the other is pulled back on a power stroke with the flaps open for greater resistance. On the return stroke the flaps are forced closed against the blade sides for reduced resistance. One or more vertical stabilizing panels attached to the lower limbs reduce side to side motion of the lower body. These may be on swim fins or mounted between the legs.

13 Claims, 3 Drawing Sheets

FLAPPING PADDLE AND VERTICAL STABILIZER FOR SWIMMER

BACKGROUND OF THE INVENTION

This invention relates to hand operated swimming aids and more particularly to paddles with movable flaps and vertical stabilizers for use with the paddles.

U.S. Pat. No. 5,348,503 issued Sep. 20, 1994 to the applicant discloses a paddle with a blade at opposite ends of a hand held shaft. Each blade has a rigid leading edge and a flexible following portion. When pushed forward, the blade lies in a plane for minimal resistance. When pulled backward on the power stroke, the following portion bends out of the plane, creating increased resistance for enhanced propulsion. This pulling action causes torso and legs to move from side to side, reducing the forward power thrust. A vertical blade held on both feet acts as a keel or stabilizer to reduce the lateral motion and convert it to forward thrust.

Canadian Patent No. 757954 issued May 1967 discloses a double ended swimmer's paddle with hinged flaps. The flaps are supposed to open on the power stroke, with cords 19 limiting the extent of opening, to create high resistance, and to close on the return stroke for low resistance. If the angle of attack is not directed between the flaps, the flaps will move in the same direction, reducing their utility. On the power stroke the flaps tend to vibrate, increasing resistance without adding thrust.

U.S. Pat. No. 2,948,255 issued Aug. 9, 1960 to Sbrana discloses resilient paired flaps that reciprocate on a paddle mechanism mounted beneath a water craft.

U.S. Pat. No. 5,362,268 issued Nov. 8, 1994 to Nordbeck discloses a foot mounted swim fin. The fin has resilient side panels which tend to bend toward one another on the return stroke.

U.S. Pat. No. 3,510,894 issued May 12, 1970 to Eriksen and U.S. Pat. No. 5,114,371 issued May 19, 1992 to Alonzo disclose a floating double ended paddle that buoys the swimmer and provides propulsion, the paddle ends are rigid.

U.S. Pat. No. 3,987,509 issued Oct. 26, 1976 to Patterman discloses a swimming tail formed by a pair of flippers to be used side by side to simulate the vertical tail of a fish, one flipper has a fin that extends back from the heel of the foot and the other has a fin that extends forward from the toe of the foot. Thrust is generated by lateral motion of the pair.

U.S. Pat. No. 4,857,024 issued Aug. 15, 1989 to Evans teaches a swim fin mounted on the foot with a shaped, horizontal blade having special flexing responses that are greater when forced through the water in a first direction than in a second direction so that greater resistance is offered on the power stroke of the kick and less on the return stroke. The propelling force is developed by a combination of the flexing of the deflectable end and the snapping action of the movable tips.

The prior art does not consider the problems related to flaps not opening correctly when the angle of attack changes nor to vibration of the flaps.

SUMMARY OF THE INVENTION

The instant invention overcomes problems encountered by the prior art by mounting a non-movable blade between two resilient flaps. A non-movable blade is mounted at a fixed position at each end of an elongate hand held shaft assembly. The two blades are coplanar. A pair of resilient flaps are each attached to the leading edge of a blade, one on each side. They extend to or past the trailing edge of the blade. When the swimmer pulls the blade on the power stroke, the flaps can only move in one direction, away from the blade, to thereby open wide to greatly increase hydrodynamic resistance. When the swimmer pushes the blade forward on the return stroke, the flaps are forced to lie flat against the blade, thereby greatly reducing resistance that would slow the swimmer.

The pulling action of the power strokes so far from the swimmer's torso causes the legs and torso to move laterally from side to side, lessening the effective forward vector. Vertical keels or stabilizing fins attached to the feet or legs may be employed to reduce the side to side motion. The vertical blade or fin that has foot receiving pockets on each side as disclosed in Applicant's U.S. Pat. No. 5,348,503 may be used for this purpose. It acts like a fish's tail, converting the legs lateral motion into forward thrust.

Swimmers may prefer to use more conventional leg swimming motions such as those that are used in conjunction with swim fins. These employ the major muscles that will enhance propulsion and exercise muscles used in training for athletic competition and in physical therapy. It is accordingly an object of the invention to provide vertical stabilizing fins or blades that attach to the feet or legs that are usable with the paddle and that enable the feet to kick alternately with swim fins.

These and other objects, advantages and features of the invention will become more apparent when the detailed description is studied with the drawings, in which like reference characters designate like elements in the various figures.

DETAILED DESCRIPTION OF PREFERRED EMBODIMENTS

Figure 1:
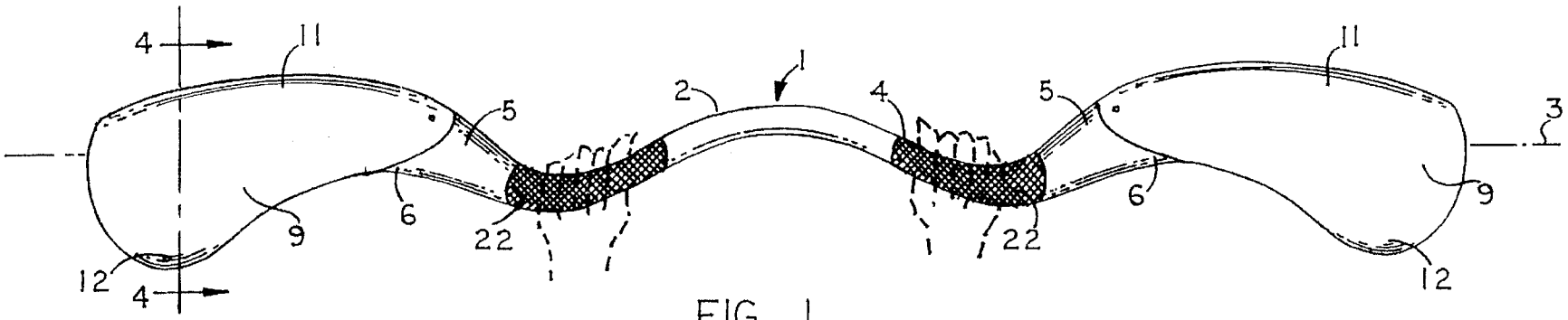
FIG. 1 is a top view of the paddle of the invention.
Figure 2:
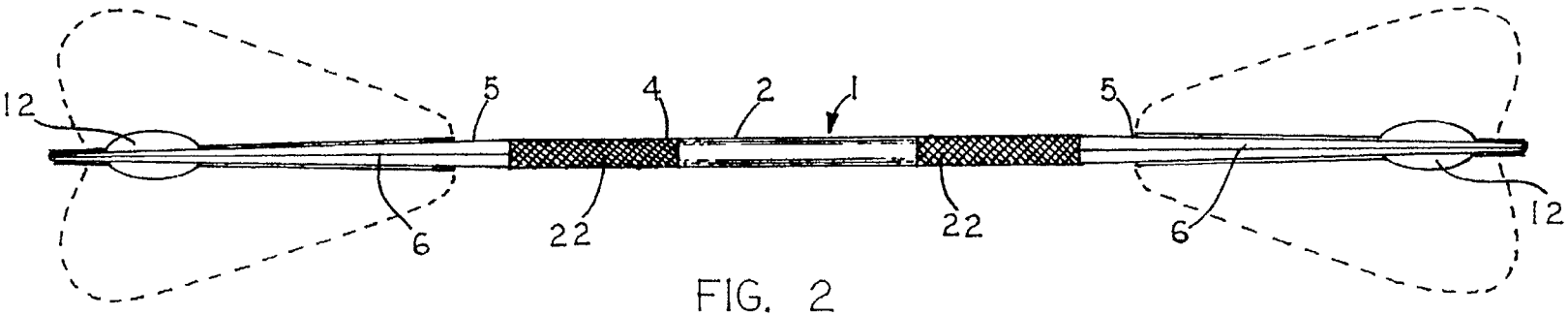
FIG. 2 is a side view of the paddle of FIG. 1.

Referring now first to FIGS. 1–5 and 9, a paddle assembly 1 has an elongate shaft 2 with a long axis 3, an intermediate portion 4 connecting two end portions 5. The intermediate portion is provided with hand grips 22.

Figure 9:
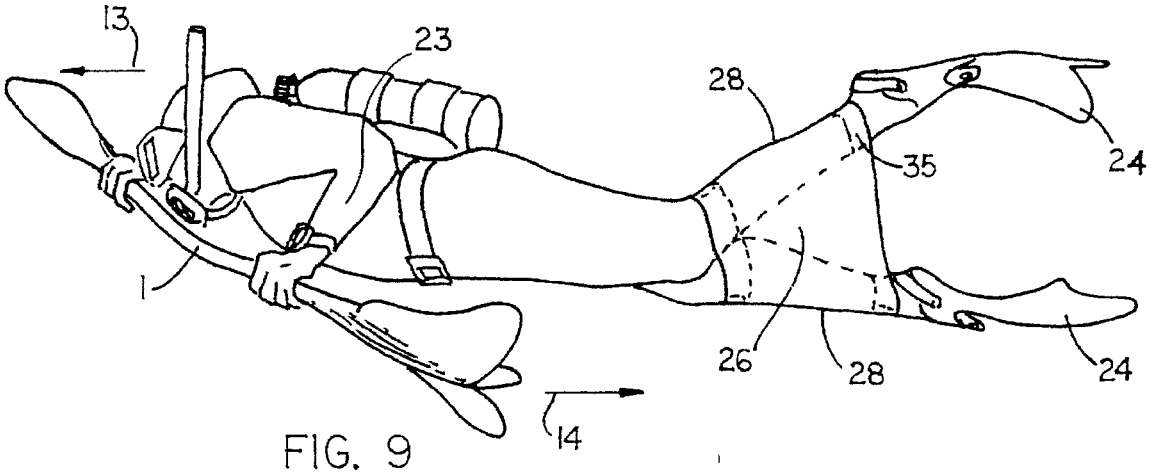
FIG. 9 is a perspective view of a swimmer using a paddle and leg web assembly of the invention with swim fins.

As best seen in FIG. 9, a swimmer grasps the hand grips 22 and applies alternating fore and aft motions with the arms. As shown, the left arm 23 is executing a pulling stroke in the direction of arrow 14 and the right arm (not shown) is executing a return stroke in the direction of arrow 13, while the swimmer's swim fins 24 are executing alternating kicking strokes.

A rigid blade 6 having a free trailing edge 7 and a leading edge 8 is affixed to each end portion 5 at the leading edge 8 so as to maintain both blades in a common plane.

Figure 5:
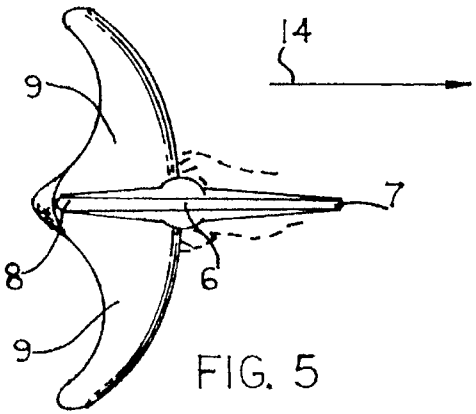
FIG. 5 is an end view of the paddle of FIG. 1.
Figure 4:
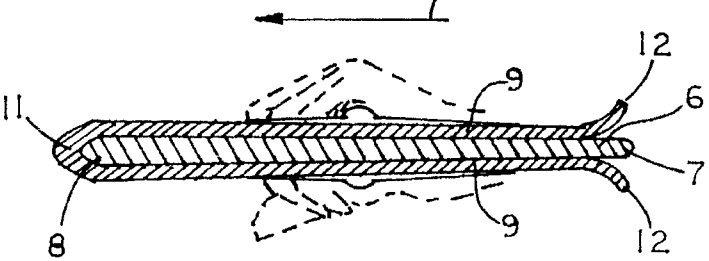
FIG. 4 is a sectional view taken through line 4—4 of FIG. 1 of another embodiment of the invention.

Each blade is provided with a pair of resilient flaps 9, one on each side of the blade, and attached to the leading edge 8 of the blade on an anterior margin 11 such that the posterior margin 12 of each flap is free to move away from the blade on a pulling stroke 14 as seen in FIGS. 5 and 9 for increased hydrodynamic resistance and to move against the side 25 of the blade on a return stroke 13 as seen in FIGS. 4 and 9 for reduced resistance.

Figure 3:
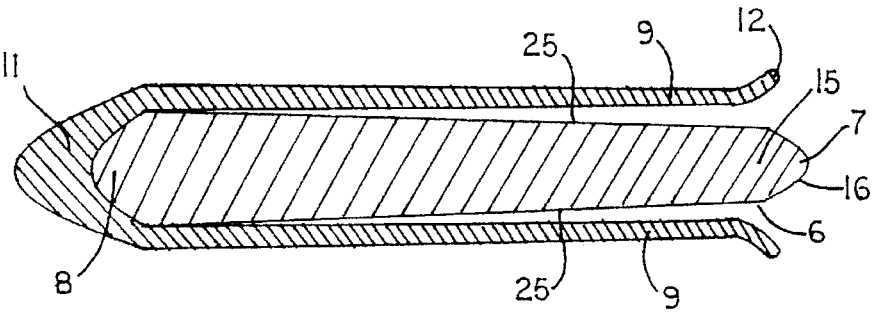
FIG. 3 is a sectional view taken through line 4—4 of FIG. 1.

The paddle assembly may be made with positive, neutral or negative buoyancy to satisfy particular requirements. The blade 6 of FIG. 4 shows a negative buoyancy configuration with a small cross section. The blade 6 of FIG. 3 shows a positive buoyancy configuration with a large cross section comprising a rigid plastic shell 16 filled with low density closed cell foam plastic 15.

The flaps may be made of a resilient material such as rubber or an elastomer having elastic properties and designed to open wide on the pulling stroke and may store enough elastic energy on opening that they impart a forward thrust when they release that energy by snapping closed when the pulling stroke stops.

Figure 6:
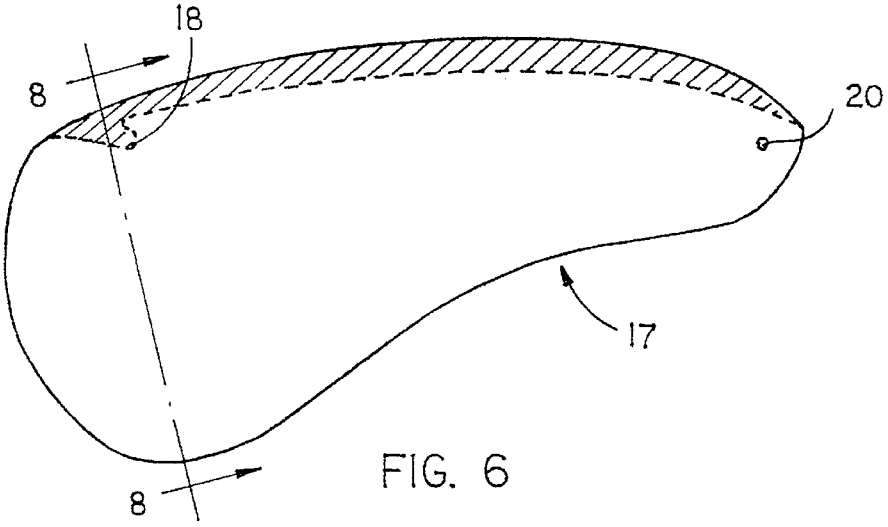
FIG. 6 is a top view of a removable flap assembly of the invention.
Figure 8:
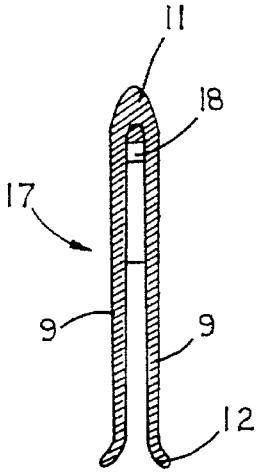
FIG. 8 is a sectional view taken through line 8—8 of FIG. 6.
Figure 7:
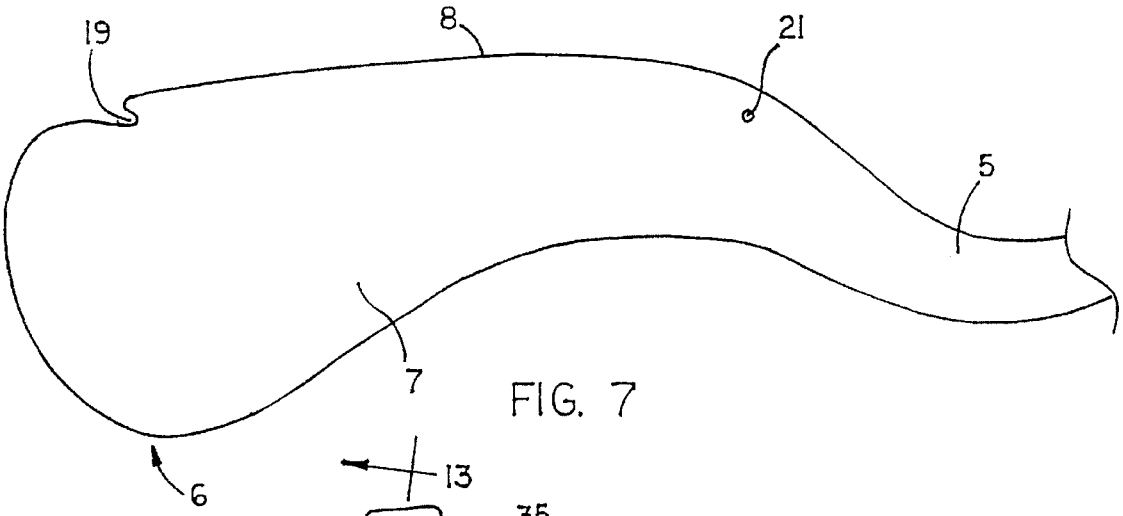
FIG. 7 is a top view of a blade for use with the flap assembly of FIG. 6.

FIGS. 6–8 illustrate an embodiment in which the rigid blade 6 is constructed for removably attaching a removable flap assembly 17 so that the paddle may be used with various flap assemblies having different properties such as greater resilience, area and the like, as desired. A notch 19 in the leading edge 8 of the blade 6 receives a projection 18 molded into the flap assembly 17 and a bolt (not shown) passes through bolt holes 20 and 21 to hold the flap assembly securely in place.

Figure 10:
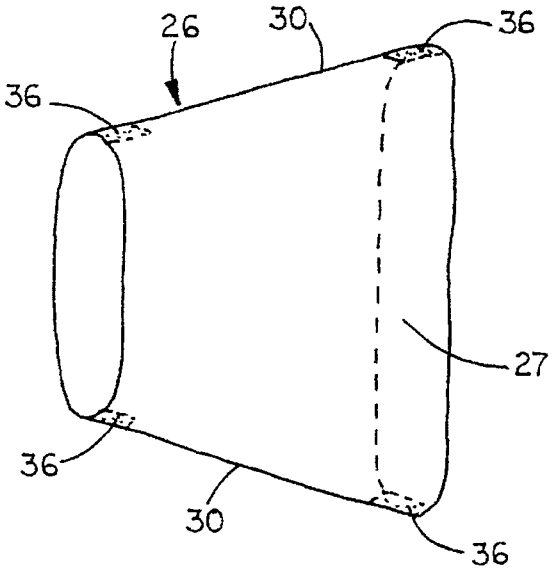
FIG. 10 is a perspective view of the web leg assembly of FIG. 9.
Figure 11:
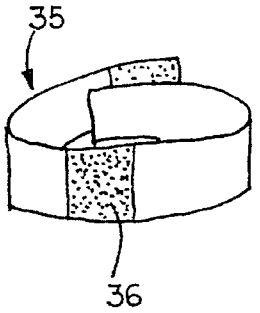
FIG. 11 is a perspective view of a leg strap that secures to the web leg assembly.

Referring now to FIGS. 9–11, it is understood that the alternating pulling strokes of the paddle assembly has two principal effects. It causes forward propulsion by pulling on the swimmer's shoulders. It also rotates the torso about the shoulders, moving the lower body from side to side and dissipating some of the energy that could otherwise generate propulsion.

Vertical stabilizing means 26 that present at least one broad panel 27 in a plane transverse to the side to side motion are removably attached to the lower limbs of the swimmer to reduce the side to side motion so that more energy is directed to forward propulsion.

A broad panel web 27 is constructed to be removably attached about the lower limbs 28 by detachable straps 31 which attach to the web 27 by hook and loop fasteners 36 at the two opposed edges 30.

This panel web 27 may be made of an elastic fabric so that the feet may be provided with swim fins 29 for alternating kicking strokes. During the kicking strokes the panel moves to alternating partially vertical positions to restrain the side to side motion.

Figure 12:
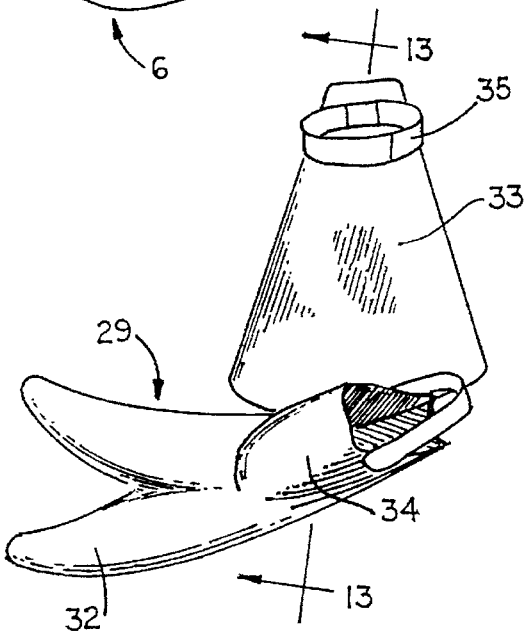
FIG. 12 is a perspective view of a swim fin of the invention with vertical keel.
Figure 13:
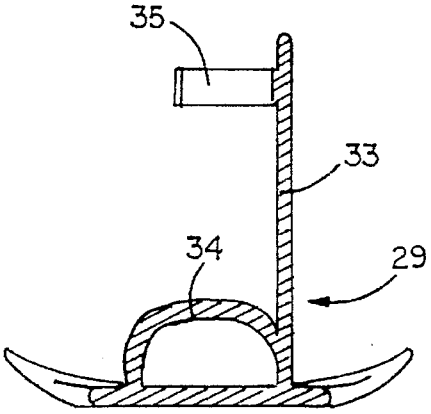
FIG. 13 is a sectional view taken through line 13—13 of FIG. 12.

FIGS. 12 and 13 show a modified swim fin 29 provided with conventional broad horizontal blade 32 and a foot attaching means 34.

The fin is provided with a vertical panel 33 affixed to the fin generally orthogonal to the horizontal blade 32 to present a vertical stabilizing means in an orientation transverse to the side to side motion of the torso. The stabilizing means may also enhance propulsion much like a fish tail as it is forced from side to side. To further maintain the position of the vertical panel 33, it may be provided with a strap 35 for securing about the lower limb.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A paddle assembly for swimming operation, the paddle assembly comprising:

an elongate shaft having a long axis and an intermediate portion connecting two end portions, the intermediate portion constructed for gripping along the long axis by two hands of a swimmer; a pair of rigid blades, each blade having a free trailing edge and a leading edge, each blade being affixed to one of the end portions so as to maintain the two blades in a common plane;

resilient flaps disposed one on either side of each blade with an anterior margin of the flap attached along substantially the entire length thereof to the leading edge of the blade and a posterior margin of the flap free to move away from the blade on a pulling stroke for increased hydrodynamic resistance and to move against the blade on a return stroke for reduced hydrodynamic resistance.

2. The paddle assembly according to claim 1, in which the blades are buoyant in water.

3. The paddle assembly according to claim 1, in which the flaps have sufficient elasticity to create forward thrust when the pulling stroke stops.

4. The paddle assembly according to claim 1, in which the resilient flaps are removably attached to the leading edge.

5. A swimming apparatus comprising:

A) a paddle assembly for two handed operation, comprising an elongate shaft having a long axis and an intermediate portion connecting two end portions, the intermediate portion constructed for gripping along the long axis by two hands of a swimmer; a pair of rigid blades, each blade having a free trailing edge and a leading edge, each blade being affixed to one of the end portions so as to maintain the two blades in a common plane;

resilient flaps disposed one on either side of each blade with an anterior margin of the flap attached along substantially the entire length thereof to the leading edge of the blade and a posterior margin of the flap free to move away from the blade on a pulling stroke for increased hydrodynamic resistance and to move against the blade on a return stroke for reduced hydrodynamic resistance; and B) a vertical stabilizing means for resisting lateral motion of a swimmer's lower body induced by operation of the paddle assembly, the vertical stabilizing means comprising at least one broad panel, the stabilizing means being attachable to the lower limbs of the swimmer and so constructed as to permit independent motion of each lower limb when so attached for independent kicking motion, while presenting the at least one panel in an orientation transverse to the side by side motion of the lower body.

6. The swimming apparatus according to claim 5, in which the blades are buoyant in water.

7. The swimming apparatus according to claim 5, in which the flaps have sufficient elasticity to create forward thrust when the pulling stroke stops.

8. The swimming apparatus according to claim 5, in which the resilient flaps are removably attached to the leading edge.

9. The swimming apparatus according to claim 5, in which the vertical stabilizing means comprises a broad flexible panel having two opposed edges, each opposed edge being provided with means for attaching to one of the lower legs of the swimmer.

10. The swimming apparatus according to claim 5, in which the vertical stabilizing means comprises two vertical panels, each panel being attached to a swim fin, the swim fin having a foot attaching means and a broad horizontal blade, the vertical panel being attached to the swim fin generally orthogonal to the broad horizontal blade.

11. The swimming apparatus according to claim 10, in which each panel is further provided with means for removably attaching to the lower limb of the swimmer.

12. A water paddle end attached to an elongate handle, the paddle end presenting reduced hydrodynamic resistance when moved by the handle in a first direction through water and presenting an increased hydrodynamic resistance when moved in a second direction opposite to said first direction through water, the improvement comprising:

an elongate handle;

a shaft having a long axis and first and second shaft ends, the shaft connected to said handle at the first shaft end;

a rigid blade having a free trailing edge and a leading edge, the blade being affixed to the second shaft end;

two resilient flaps disposed one on either side of the blade, each flap having an anterior margin attached along substantially the entire length thereof to the leading edge of the blade and having a posterior margin of the flap free to move away from the blade on movement in said second direction for increased hydrodynamic resistance, and to flatten against the blade on movement in said first direction for reduced hydrodynamic resistance.

13. The invention according to claim 12, in which the resilient flaps are removably attached to the leading edge of the rigid blade.

* * * * *